US008179047B2

(12) United States Patent
Espiau et al.

(10) Patent No.: US 8,179,047 B2
(45) Date of Patent: May 15, 2012

(54) METHOD AND SYSTEM FOR ADJUSTING THE FREQUENCY OF A RESONATOR ASSEMBLY FOR A PLASMA LAMP

(75) Inventors: Frederick M. Espiau, Topanga, CA (US); Mehran Matloubian, Encino, CA (US); Timothy J. Brockett, Oakland, CA (US)

(73) Assignee: Topanga Technologies, Inc., Canoga Park, CA (US)

( * ) Notice: Subject to any disclaimer, the term of this patent is extended or adjusted under 35 U.S.C. 154(b) by 318 days.

(21) Appl. No.: 12/624,384

(22) Filed: Nov. 23, 2009

(65) Prior Publication Data

US 2010/0134013 A1 Jun. 3, 2010

Related U.S. Application Data

(60) Provisional application No. 61/117,485, filed on Nov. 24, 2008.

(51) Int. Cl.
*H01J 19/80* (2006.01)

(52) U.S. Cl. ..... 315/39; 315/39.51; 315/248

(58) Field of Classification Search ..... 315/39, 315/39.51, 248; 313/634, 636
See application file for complete search history.

(56) References Cited

U.S. PATENT DOCUMENTS 4,975,655 A 12/1990 Dawson et al.
5,686,793 A 11/1997 Turner et al.
5,777,857 A 7/1998 Degelmann
5,786,667 A * 7/1998 Simpson et al. ..... 315/39
5,838,108 A 11/1998 Frank et al.
5,886,480 A 3/1999 Penzenstadler et al.
5,923,122 A 7/1999 Frank et al.
6,241,369 B1 6/2001 Mackiewicz
6,617,806 B2 9/2003 Kirkpatrick et al.
6,737,809 B2 5/2004 Espiau et al.
6,922,021 B2 7/2005 Espiau et al.
7,119,641 B2 10/2006 Petrov et al.
7,276,860 B2 * 10/2007 Choi et al. ..... 315/248
7,348,732 B2 3/2008 Espiau et al.
7,350,936 B2 4/2008 Ducharme et al.
7,358,678 B2 4/2008 Espiau et al.
(Continued)

OTHER PUBLICATIONS

International Search Report and Written Opinion of PCT Application No. PCT/US2009/048174, dated Jan. 26, 2010, 15 pages total.

(Continued)

*Primary Examiner* — Douglas W Owens
*Assistant Examiner* — Tung X Le
(74) *Attorney, Agent, or Firm* — Kilpatrick Townsend & Stockton LLP

(57) ABSTRACT

A plasma electrodeless lamp comprises a substantially hollow metallic body, closely receiving two coupling elements, the first coupling element connected to the output of an RF amplifier, and the second coupling element connected to the input of an RF amplifier. The first coupling element is conductively connected (grounded) to metallic lamp body at its top surface, while the second coupling element is not. The lamp further comprises a vertical metallic post, the post being grounded to the metallic lamp body at the post's bottom surface. The lamp further comprises a dielectric sleeve which closely receives the metallic post, and which is in turn closely supported by the lamp body or alternatively or in combination a tuning stub. The lamp further comprises a bulb that is closely received by the metallic post, and that encloses a gas-fill which forms a radiant plasma when excited.

12 Claims, 10 Drawing Sheets

U.S. PATENT DOCUMENTS

| | | | | |
|---|---|---|---|---|
| 7,362,054 | B2 | 4/2008 | Espiau et al. | |
| 7,362,055 | B2 | 4/2008 | Espiau et al. | |
| 7,362,056 | B2 | 4/2008 | Espiau et al. | |
| 7,372,209 | B2 | 5/2008 | Espiau et al. | |
| 7,391,158 | B2 | 6/2008 | Espiau et al. | |
| 7,880,402 | B2 * | 2/2011 | DeVincentis et al. | 315/248 |
| 2002/0135322 | A1 * | 9/2002 | Hochi et al. | 315/248 |
| 2005/0093481 | A1 * | 5/2005 | Gao et al. | 315/248 |
| 2006/0250090 | A9 | 11/2006 | Guthrie | |
| 2008/0258627 | A1 | 10/2008 | Devincentis et al. | |
| 2009/0167201 | A1 * | 7/2009 | Duelli et al. | 315/248 |

OTHER PUBLICATIONS

Notification Concerning Transmittal of International Preliminary Report on Patentabiliy (Chapter 1 of the Patent Cooperation Treaty) of PCT Application No. PCT/US2009/065756, dated Jun. 3, 2011, 6 pages total.

* cited by examiner

METHOD AND SYSTEM FOR ADJUSTING THE FREQUENCY OF A RESONATOR ASSEMBLY FOR A PLASMA LAMP

CROSS-REFERENCES TO RELATED APPLICATIONS

This application claims priority to U.S. Provisional Patent Application No. 61/117,485, filed Nov. 24, 2008, commonly assigned, and hereby incorporated by reference herein.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates generally to lighting techniques. In particular, the present invention provides a method and device using a plasma lighting device having one of a plurality of base configurations. More particularly, the present invention provides a method and resulting system for adjusting a frequency for a resonator assembly of a plasma lighting device. Merely by way of example, such configurations can include at least warehouse lamps, stadium lamps, lamps in small and large buildings, street lamps, parking lot lamps, and other applications that can be retrofitted, and the like.

From the early days, human beings have used a variety of techniques for lighting. Early humans relied on fire to light caves during hours of darkness. Fire often consumed wood for fuel. Wood fuel was soon replaced by candles, which were derived from oils and fats. Candles were then replaced, at least in part by lamps. Certain lamps were fueled by oil or other sources of energy. Gas lamps were popular and still remain important for outdoor activities such as camping. In the late 1800s, Thomas Edison invented a reliable incandescent lamp, which uses a tungsten filament within a bulb, coupled to a pair of electrodes. Many conventional buildings and homes still use the incandescent lamp, commonly called the Edison bulb. Although highly successful, the Edison bulb consumes too much energy and is generally inefficient.

Fluorescent lighting replaced incandescent lamps for certain applications. Fluorescent lamps generally consist of a tube containing a gaseous material, which is coupled to a pair of electrodes. The electrodes are coupled to an electronic ballast, which helps ignite the discharge from the fluorescent lighting. Conventional building structures often use fluorescent lighting, rather than the incandescent counterpart. Fluorescent lighting is much more efficient than incandescent lighting, but often has a higher initial cost.

Shuji Nakamura pioneered the efficient blue light emitting diode. The blue light emitting diode forms a basis for the white solid state light, which is often a blue light emitting diode coated with a yellow phosphor material. Blue light excites the phosphor material to emit white lighting. The blue light emitting diode has revolutionized the lighting industry to replace traditional lighting for homes, buildings, and other structures.

Another form of lighting is commonly called the electrodeless lamp, which can be used to discharge light for high intensity applications. Frederick M. Espiau was one of the pioneers that developed an improved electrode-less lamp. Such electrode-less lamp relied solely upon a solid ceramic resonator structure fixed against a fill enclosed in a bulb. The bulb was coupled to the resonator structure via rf feeds, which transferred power to the fill to cause it to discharge high intensity lighting. Another example of a conventional technique for improving the electrode-less lamp is described in "Frequency Tunable Resonant Cavity For Use with An Electrodeless Plasma Lamp," in the name of Marc DeVincentis and Sandeep Mudunuri listed as U.S. Publication No. 2008/0258627A1, which is limited to tuning a solid dielectric resonator that has drawbacks. Although somewhat successful, the electrode-less lamp still had many limitations. As an example, electrode-less lamps have not been successfully deployed on a wide scale.

From the above, it is seen that improved techniques for lighting are highly desired.

BRIEF SUMMARY OF THE INVENTION

According to the present invention, techniques for lighting are provided. In particular, the present invention provides a method and device using a plasma lighting device having one of a plurality of base configurations. More particularly, the present invention provides a method and resulting system for adjusting a frequency for a resonator assembly for a plasma lamp, which can be used for a variety of applications. The ability to adjust (tune) the frequency of the resonator assembly significantly improves manufacturing yield, simplifies manufacturing by reducing the tolerances of the dimensions of the resonator, and improves lamp performance. In addition one can compensate for any changes in the resonant frequency of the resonator caused by temperature fluctuations or aging. The plasma lamps have applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

In one aspect, the plasma electrodeless lamp comprises a substantially hollow metallic body, closely receiving two coupling elements, the first coupling element connected to the output of an RF amplifier, and the second coupling element connected to the input of an RF amplifier. The first coupling element is conductively connected (e.g., grounded) to metallic lamp body at its top surface, while the second coupling element is not. The lamp further comprises a vertical metallic post, the post being grounded to the metallic lamp body at the post's bottom surface. The lamp further comprises a dielectric sleeve which closely receives the metallic post, and which is in turn closely supported by the lamp body. The lamp further comprises a bulb that is closely received by the metallic post, and that encloses a gas-fill which forms a radiant plasma when excited. Electromagnetic energy is coupled between the first coupling element and the post, and between the post and the second coupling element; this coupling is both inductive and capacitive in nature. In some embodiments, the coupling may be dependent upon excitation frequency, among other factors. In another aspect, the second coupling element is removed, and the first coupling element is connected to the output of an RF source, which may further comprise an RF oscillator and an amplifier.

In a specific embodiment, the present invention provides a plasma lamp apparatus. The lamp includes a housing having a spatial volume defined within the housing. In a specific embodiment, the spatial volume has an inner region and an outer region. In a specific embodiment, the housing can be a substantially hollow metallic body. In a specific embodiment, the lamp also includes a support region coupled to the inner region of the spatial volume. The lamp has a support body having an outer surface region disposed within or partially disposed within the support region. In a specific embodiment, the support body has a support length, a support first end, and a support second end. The second end is coupled to one or more portions of the housing. In a specific embodiment, the support body can be a metallic post or other suitable member, including combination of metallic and dielectric materials. In a specific embodiment, the lamp has a gas-filled vessel coupled to the support first end of the support body. The gas filled vessel has a transparent or translucent body, an inner surface and an outer surface, a cavity formed within the inner surface. The gas filled vessel is filled with an inert gas such as argon and a light emitter or fluorophor such as mercury, sodium, dysprosium, sulfur or a metal halide salt such as indium bromide, scandium bromide, Thallium Iodide, Holmium Bromide, Cesium Iodide or other similar materials (or it can simultaneously contain multiple light emitters or fluorophors). In another embodiment, the lamp has a quartz body disposed around one or more portions of the support body. In a specific embodiment, the quartz body is configured with one of a plurality of spatial sizes to provide a selected capacitance for a resonating frequency from a plurality of frequencies. The lamp also has an rf source operably coupled to the gas-filled vessel. In a specific embodiment, the rf source is configured with the quartz body to output the resonating frequency for a discharge of one or more gases in the gas filled vessel. In a preferred embodiment, the discharge is a gas discharge to emit electromagnetic radiation. The gas discharge also includes interaction with the light emitter(s) or fluorophor(s) in one or more embodiments.

In an alternative specific embodiment, the present invention provides a plasma lamp apparatus. The lamp has a housing having a spatial volume defined within the housing. The spatial volume has an inner region and an outer region. The lamp also has a support region coupled to the inner region of the spatial volume. The lamp further has a support body having an outer surface region disposed within or partially disposed within the support region. In a specific embodiment, the support body has a support length, a support first end, and a support second end. The lamp has a gas-filled vessel coupled to the support first end of the support body. In a preferred embodiment, the gas filled vessel has a transparent or translucent body, an inner surface and an outer surface, a cavity formed within the inner surface. The lamp also has a dielectric body disposed around one or more portions of the support body. In a preferred embodiment, the dielectric body is configured with a spatial size to provide a selected capacitance for a resonating frequency from a plurality of frequencies. The lamp also has an rf source operably coupled to at least the first end of the gas-filled vessel. In a specific embodiment, the rf source is configured with the dielectric body to output the resonating frequency for a discharge of one or more gases in the gas filled vessel. In a preferred embodiment, the discharge is a gas discharge to emit electromagnetic radiation. The gas discharge also includes interaction with the light emitter(s) or fluorophor(s) in one or more embodiments.

In an alternative specific embodiment, the present invention provides a method of manufacturing plasma lamps. The method includes providing a plasma lamp apparatus comprising a housing having a spatial volume defined within the housing. In a specific embodiment, the spatial volume has an inner region and an outer region. In a specific embodiment, the plasma lamp assembly also has a support region coupled to the inner region of the spatial volume. The method includes inserting a lamp device comprising a gas filled vessel coupled to a support body to a region within or partially within the support region of the inner region of the spatial volume of the housing. The method also includes selecting a spatial size of a quartz body to provide a resonating frequency from a plurality of resonating frequencies and disposing the quartz body around the support body. In a specific embodiment, the quartz body is configured in the spatial size to provide the resonating frequency from a plurality of frequencies.

Moreover, the present invention provides an electrode-less plasma lamp apparatus. The apparatus includes a plasma lamp apparatus comprising a housing having a spatial volume defined within the housing. The spatial volume has an inner region and an outer region according to a specific embodiment. The plasma lamp assembly has a support region coupled to the inner region of the spatial volume according to a specific embodiment. The apparatus also includes one or more fluid materials within the outer region of the housing and a support body provided within or partially within the support region of the housing. The apparatus has a lamp device comprising a gas filled vessel coupled to at least one end of the support body. The apparatus has an rf coupling element provided within one or more portions of the outer region. The rf coupling element is configured to supply energy to the plasma lamp device. The apparatus has a tuning device operably coupled to one or more portions of the one or more fluid materials and configured to change a resonating frequency from at least a first value to a second value.

Still further, the present invention provides a method of configuring a plasma lamp. The method includes providing a plasma lamp apparatus comprising a housing having a spatial volume defined within the housing. The spatial volume has an inner region and an outer region, the plasma lamp assembly having a support region coupled to the inner region of the spatial volume. The outer region comprises one or more fluid materials to form a cavity region according to one or more embodiments. The method includes coupling a support body provided within or partially within the support region of the housing and coupling a lamp device comprising a gas filled vessel coupled to at least one end of the support body. The method includes coupling an rf coupling element provided within one or more portions of the outer region. The rf coupling element is configured to supply energy to the plasma lamp device. The method also includes providing a tuning device operably coupled to one or more portions of the one or more fluid materials and configured to change a resonating frequency from at least a first value to a second value.

Benefits are achieved over pre-existing techniques using the present invention. In a specific embodiment, the present invention provides a method and device having configurations of input, output, and feedback coupling elements that provide for electromagnetic coupling to the bulb whose power transfer and frequency resonance characteristics that are largely independent of the conventional dielectric resonator, but can also be dependent upon conventional designs. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods for street lighting applications.

Still further, the present method and device provide for improved heat transfer characteristics, as well as further simplifying manufacturing and/or retrofitting of existing and new street lighting, such as lamps, and the like. In a specific embodiment, the present method and resulting structure are relatively simple and cost effective to manufacture for commercial applications. In a preferred embodiment, the present lamp includes a tuning device that allows for more efficient manufacturing, lamp setup, and maintenance. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

DETAILED DESCRIPTION OF THE INVENTION

Figure 1:
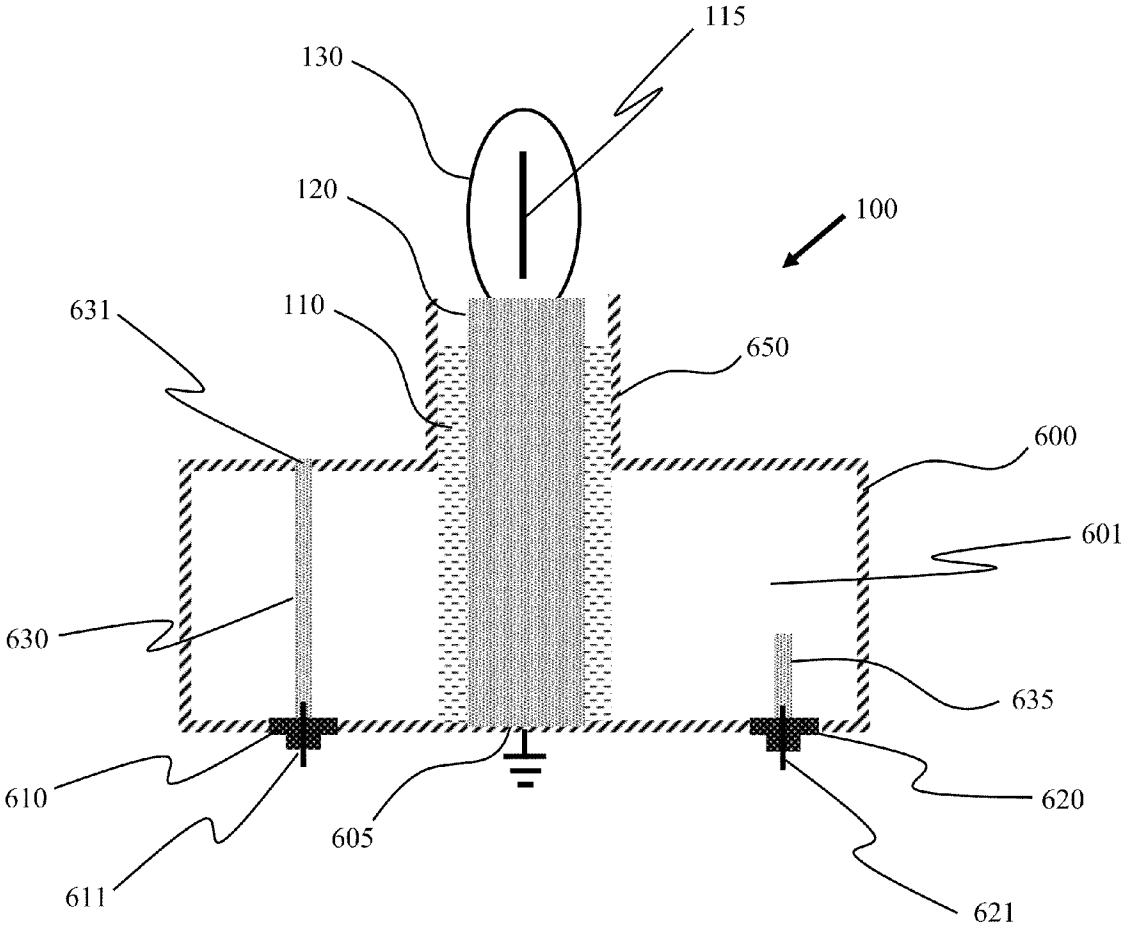
FIG. 1 is a simplified side-cut view of a lamp, comprising a lamp body, input and feedback coupling elements, a dielectric sleeve, a center metallic post, and a gas-filled bulb according to an embodiment of the present invention.

According to the present invention, techniques for lighting are provided. In particular, the present invention provides a method and device using a plasma lighting device having one of a plurality of base configurations, e.g., compact air resonator, air resonator, air resonator including a dielectric insert or sleeve. More particularly, the present invention provides a method and resulting system for adjusting a frequency for a resonator assembly for a plasma lamp, which can be used for a variety of applications. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the Claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

FIG. 1 is a side-cut view of a lamp, generally referred to by index 100, employing a substantially hollow metallic lamp body 600, enclosing the unfilled space 601. Metallic lamp body 600 constitutes an electrical ground, as indicated. It has been found through both electromagnetic modeling and experimentation that overall lamp operation is not sensitive to either the outer shape of the body 600, or the shape of the enclosed space 601. For example, body 600 may be rectilinear, while hollow space 601 may be cylindrical. Of course, there can be other variations, modifications, and alternatives.

Lamp body 600 includes a hollow protruding feature 650. The hollow space 601 and hollow protruding feature 650 together receive a dielectric sleeve 110. Example embodiments of the dielectric sleeve 110 may include quartz and alumina, although other materials of various dielectric constants may be used. The height of the protruding feature 650, as well as the height of the dielectric sleeve 110 within the protruding feature 650, are design variables that serve to tune the optimal operating frequency of the lamp. Closely received within the dielectric sleeve 110 is the output coupling element

120, which is a solid metallic cylindrical post, or a dielectric material coated with highly electrically conductive metallic layer, or other suitable member. Those skilled in the art will recognize that the cross section may be of many shapes, but ease of manufacturing would make a circular cross section preferable, while avoidance of high electromagnetic field concentrations that may lead to arcing would make cross sections with sharp features undesirable. It is an aspect of the invention that output coupling element 120 is grounded to the body 600 by contact, depicted in FIG. 1 at point 605. It is also an aspect of the invention that the top of output coupling element 120 closely receives and is in intimate contact with gas-fill bulb 130, which when excited by the electromagnetic field near the output coupling element 120 forms a radiant plasma filament 115. A slight depression corresponding to the shape of bulb 130 may exist at the top of output coupling element 120 to positively receive the former; a thin layer of high temperature dielectric material such as alumina may be configured with an adhesive to enhance the mechanical interface. In a specific embodiment, the thin layer of high temperature dielectric material is a very thin dielectric material. In one or more embodiments, the dielectric material may also act as a diffusion barrier between the bulb and the metal output coupling element. The use of the solid metallic post 120 and its intimate contact with bulb 130 confer at least one or more advantages: heat is efficiently removed from the bulb 130 via conduction, electromagnetic field strength decreases rapidly away from the post, minimizing EMI, and arcing between the post 120 and surrounding dielectric surfaces is eliminated.

The lamp body 600 receives the coaxial connector 610 at a bottom opening such that the outer surface of the connector is electrically contacting the lamp body 600. An example connector type is SMA, although may others are possible. The insulated center conductor 611 of the coaxial connector 610 is connected to input coupling element 630. It is a key aspect of the invention that input coupling element 630 is electrically isolated from the lamp body 600 near the connector 610, but is in direct electrical contact with the lamp body 600 on the opposite face at point 631. This so-called grounded coupling element permits efficient electromagnetic coupling to the center post 120. The coupling between the input coupling element and the output coupling element depends on the length of the input coupling element, the separation between the coupling elements, and the diameter of the coupling elements, and possibly other factors according to one or more embodiments. The insulated center conductor 621 of the coaxial connector 620 is connected to feedback coupling element 635. The outer surface of coaxial connector 620 is received by and in electrical contact with the lamp body 600, while the feedback coupling element 635 is not in DC electrical contact with the lamp body 600.

Electromagnetic energy is coupled strongly from the input coupling element 630 to the output coupling element 120, and in turn to the gas fill within bulb 130. It is an aspect of the invention that the impedance matching between the source of electromagnetic energy and the center post/bulb system (120/130) is well mediated by the separation between the input coupling element 630 and the output coupling element 120. This offers an effective adjustment mechanism that imposes no additional manufacturing burden. Electromagnetic energy is coupled weakly to the feedback coupling element 635 from the output coupling element 120. The strength of this feedback coupling is mediated by the length of feedback coupling element 635.

The coupling between input coupling element 630 and output coupling element 120, and between output coupling element 120 and feedback coupling element 635, are found through electromagnetic simulation, and through direct measurement, to be highly frequency selective. The presence of the dielectric sleeve 110 serves to reduce the frequency of optimal coupling, which is a desirable trait overall. In addition, the optimal frequency can be tuned easily by adjusting the length and thickness of dielectric sleeve 110 without imposing additional manufacturing burden.

Figure 2:
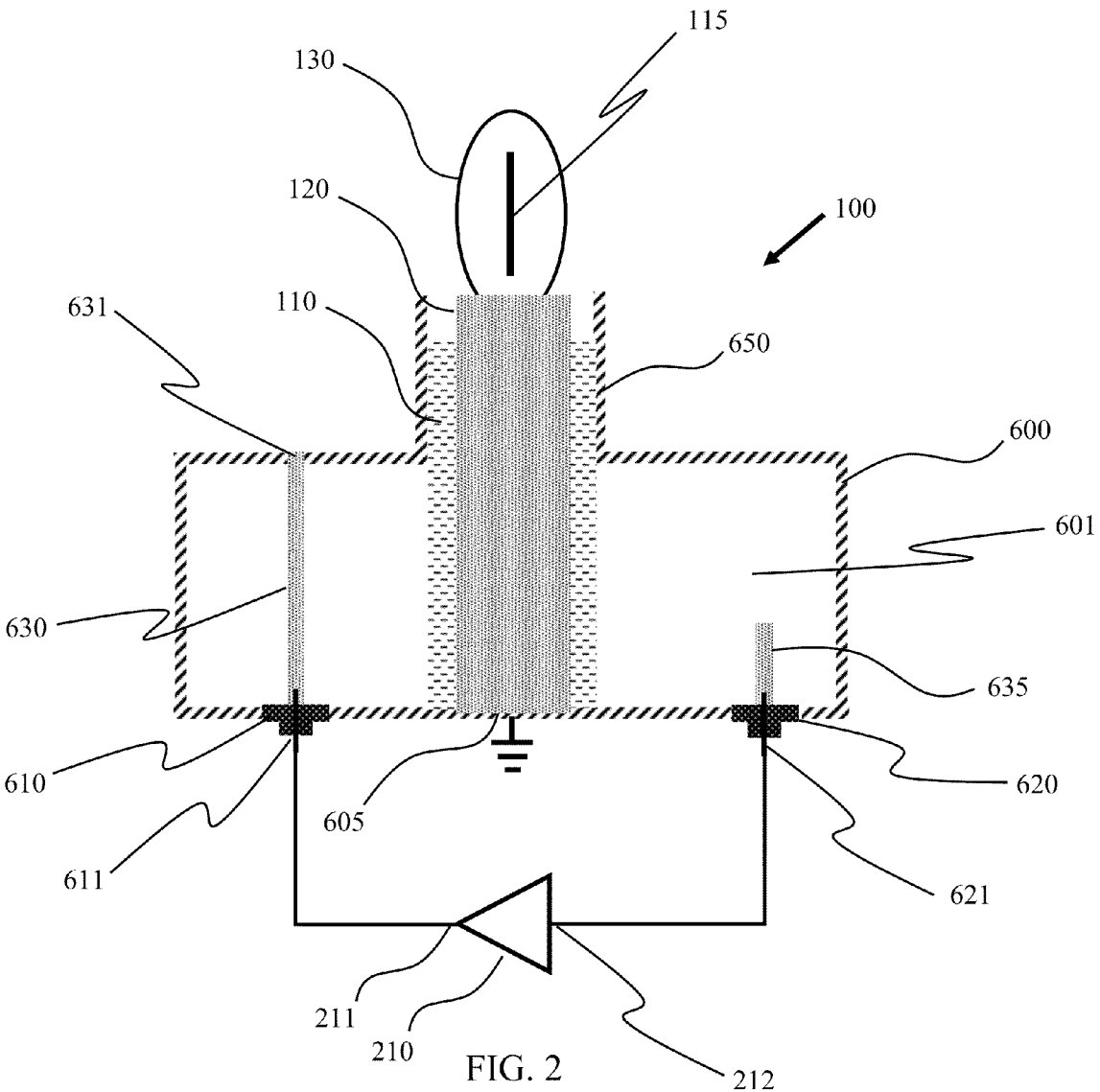
FIG. 2 shows the lamp of FIG. 1, connected in a positive-feedback topology with an RF amplifier such that the lamp/amplifier system forms an oscillator that is the source of the RF excitation for the gas-filled bulb according to an embodiment of the present invention.

FIG. 2 shows a lamp system with the lamp of FIG. 1 in a positive-feedback, self-oscillating configuration. The input coupling element 630 is electromagnetically connected with RF amplifier output 211 using coaxial cable, while the feedback coupling element 635 is electromagnetically connected with RF amplifier input 212 using coaxial cable. The frequency selectivity of the lamp provides for a resonant oscillator in the circuit comprising the input coupling element 630, the lamp 100, the feedback coupling element 635, and the amplifier 210. That is, the circuit will resonate at any frequency for which the loop gain is greater than unity, and for which the round-trip phase change is an integral multiple of 2-pi. As can be appreciated by one of ordinary skill in the art, the round-trip phase change can be tailored by various means, such as adjusting the length of the coaxial cables between the lamp and the amplifier, and incorporating passive or active RF phase shifter elements. As discussed above, advantages of the present invention are the ability to tune the resonant frequency by changing the dimensions of the dielectric sleeve 110, and the ability to impedance-match the lamp 100 to the amplifier 210 by the separation distance between the input coupling element 630 and the output coupling element 120.

Figure 3:
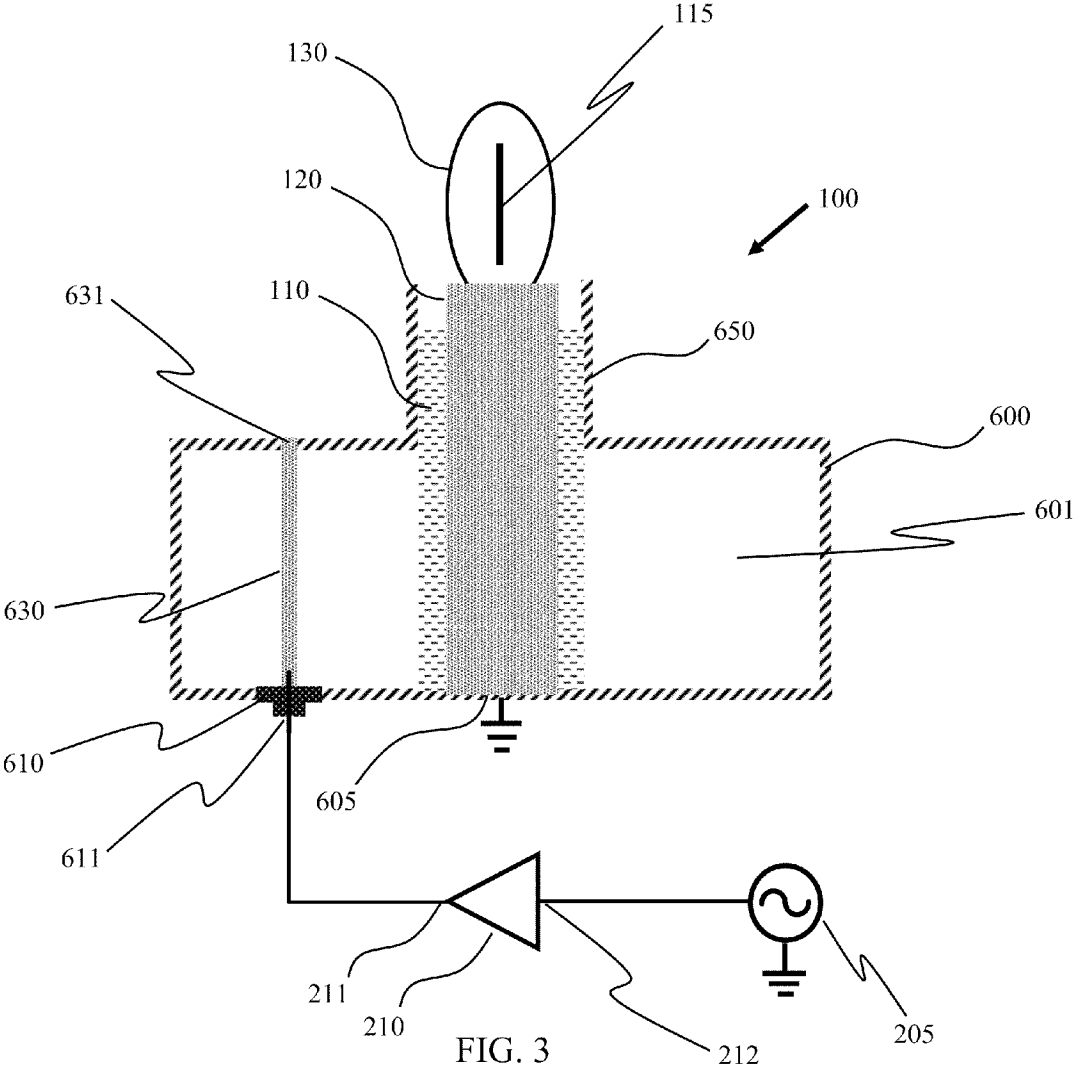
FIG. 3 shows the lamp of FIG. 1, absent the feedback coupling element, and with an RF excitation source connected to the input coupling element according to an embodiment of the present invention.

The lamp system depicted in FIG. 3 differs from that in FIG. 2 in its RF source, which is not a distributed oscillator circuit, but rather a separate oscillator 205 conductively connected with RF amplifier input 212 of RF amplifier 210. RF amplifier output 211 is conductively connected with input coupling element 630, which delivers RF power to the lamp body 100. The resonant characteristics of the coupling between the input coupling element 630 and the output coupling element 120 are frequency-matched and impedance-matched to the RF source to optimize RF power transfer. As discussed above, significant advantages of the present invention are the ability to tune the resonant frequency by changing the dimensions of the dielectric sleeve 110, and the ability to impedance-match the lamp 100 to the amplifier 210 by the separation distance between the input coupling element 630 and the output coupling element 120. Of course, there can be other variations, modifications, and alternatives.

Figure 4A:
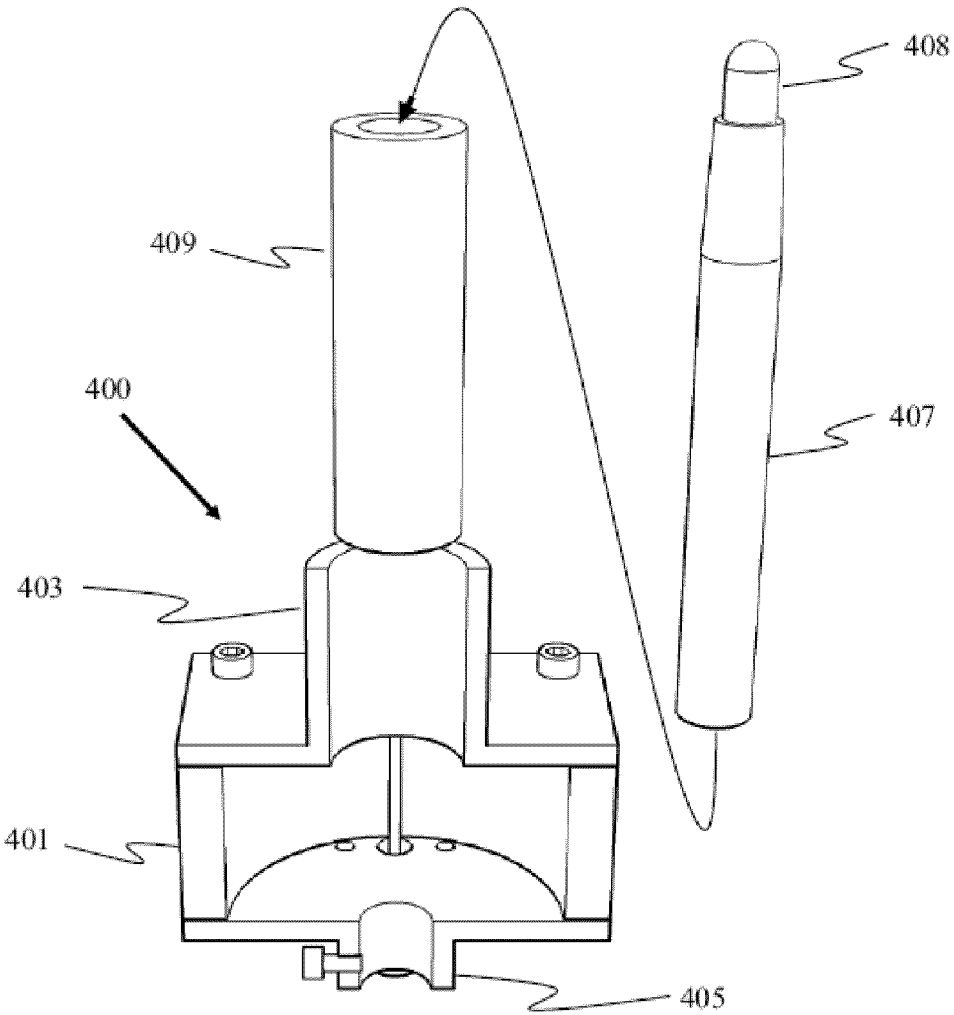
FIG. 4A is a perspective view of a lamp device illustrating a quartz body and detached bulb assembly according to an embodiment of the present invention.

FIG. 4A is a perspective view of a lamp device 400 illustrating a quartz body and detached bulb assembly according to an embodiment of the present invention. This diagram is merely an illustration, which should not limit the scope of the claims herein. One of ordinary skill in the art would recognize other variations, modifications, and alternatives. As shown, the present invention provides a plasma lamp apparatus 400. The lamp has a housing 401 having a spatial volume defined within the housing. The spatial volume has an inner region and an outer region. In a specific embodiment, the housing is made of a conductive or metal material, but can be others. Of course, there can be other variations, modifications, and alternatives.

In a specific embodiment, the lamp also has a support region 403 or 405 coupled to the inner region of the spatial volume. In a specific embodiment, the support region can be made from a portion of the housing or other separate member. Of course, there can be other variations, modifications, and alternatives. In a specific embodiment, the support region can be annular, polygon shaped, or other shape to be configured to a support body, which will be described further below.

As shown, the lamp further has a support body (output coupling element) 407 having an outer surface region disposed within or partially disposed within the support region. In a specific embodiment, the support body has a support length, a support first end, and a support second end. In a specific embodiment, the support body is made of a conductive metal material, or a dielectric material coated with a highly electrically conductive metallic layer, or other suitable materials. Of course, there can be other variations, modifications, and alternatives.

In a specific embodiment, the lamp has a gas-filled vessel 408 coupled to the support first end of the support body. In a preferred embodiment, the gas filled vessel has a transparent or translucent body, an inner surface and an outer surface, a cavity formed within the inner surface. In a specific embodiment, the gas filled vessel is a bulb, which holds an inert gas such as Argon and a light emitter or fluorophor such as Mercury, Sodium, Dysprosium, Sulfur or a metal halide salt such as Indium Bromide, Scandium Bromide, Thallium Iodide, Holmium Bromide, Cesium Iodide or other similar materials (or it can simultaneously contain multiple light emitters or fluorophors).

As also shown, the lamp also has a dielectric body 409 disposed around one or more portions of the support body. In a preferred embodiment, the dielectric body is configured with a spatial size to provide a selected capacitance for a resonating frequency from a plurality of frequencies. In a specific embodiment, the dielectric body is made of quartz or other material. The dielectric body is configured to be annular in shape or other shape to fit around the support member, as shown. In a specific embodiment, the dielectric body has a selected size and shape to provide the selected capacitance for the resonating frequency. Of course, there can be other variations, modifications, and alternatives.

As noted, the lamp also has other elements. In a specific embodiment, the lamp also has an rf source operably coupled to at least the first end of the gas-filled vessel. In a specific embodiment, the rf source is configured with the dielectric body to output the resonating frequency for a discharge of one or more gases in the gas filled vessel. The rf source includes an amplifier or other suitable device. Of course, there can be other variations, modifications, and alternatives.

Figure 4B:
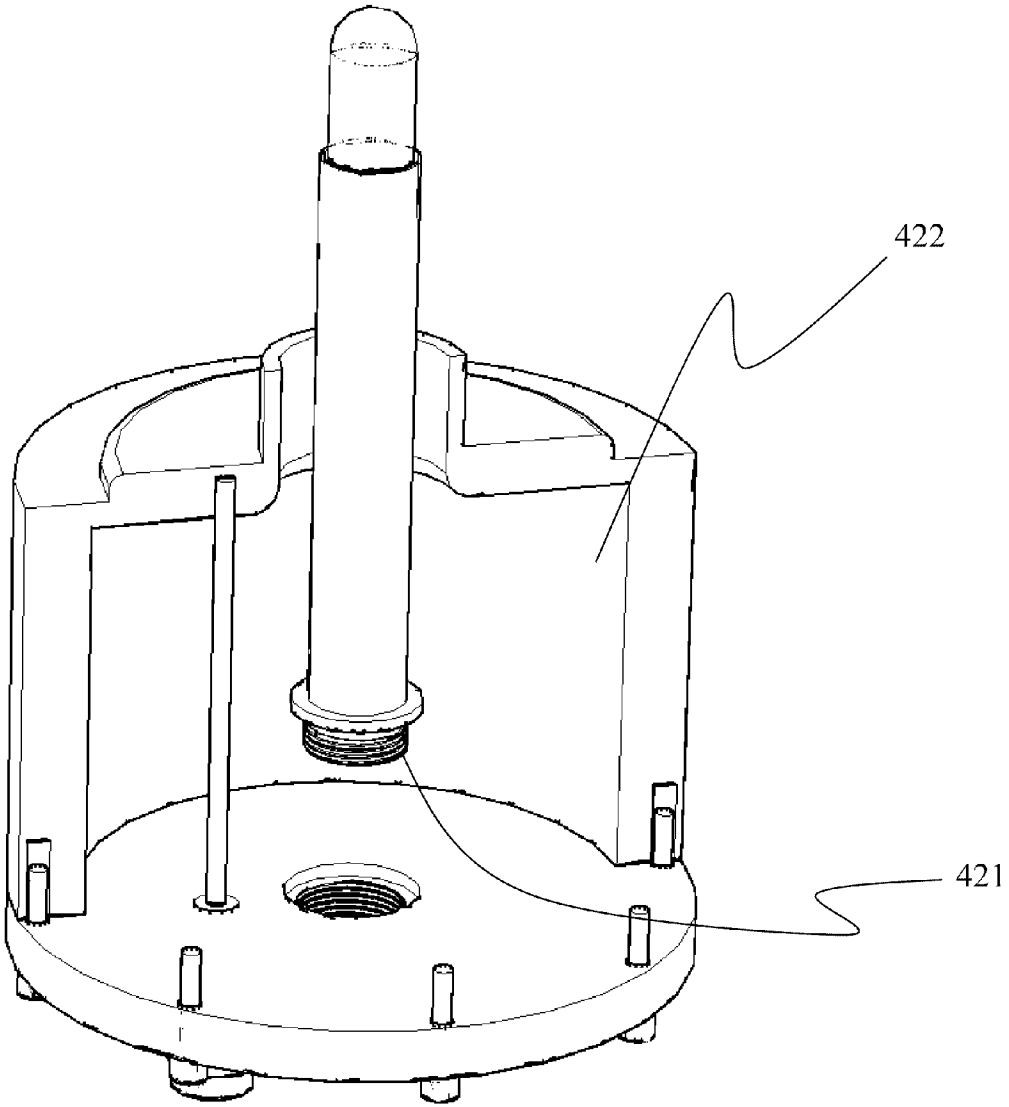
FIG. 4B is a perspective view of a lamp device illustrating an air resonator and detached bulb assembly according to an alternative embodiment of the present invention.

FIG. 4B is a perspective view of a lamp device illustrating an air resonator and detached bulb assembly according to an embodiment of the present invention. This diagram is merely an illustration, which should not limit the scope of the claims herein. One of ordinary skill in the art would recognize other variations, modifications, and alternatives. Like reference numerals are used in the present embodiment for illustrative purposes only without limiting the scope of the claims herein. As shown, the present invention provides a plasma lamp apparatus. The lamp has a housing having a spatial volume defined within the housing. The spatial volume has an inner region and an outer region. In a specific embodiment, the housing is made of a conductive or metal material, but can be others. Of course, there can be other variations, modifications, and alternatives.

In a specific embodiment, the lamp also has a support region coupled to the inner region of the spatial volume. In a specific embodiment, the support region can be made from a portion of the housing or other separate member. Of course, there can be other variations, modifications, and alternatives. In a specific embodiment, the support region can be annular, polygon shaped, or other shape to be configured to a support body, which will be described further below.

As shown, the lamp further has a support body (output coupling element) having an outer surface region disposed within or partially disposed within the support region. In a specific embodiment, the support body has a support length, a support first end, and a support second end. In a specific embodiment, the support body is made of a conductive metal material, or a dielectric material coated with a highly electrically conductive metallic layer, or other suitable materials. As also shown, one end of the support body can be configured with mechanical threads or other attachment means to mechanically couple to one or more portions of the housing. In a preferred embodiment, the mechanical threads can allow for ease in manufacturing and/or replacement of the support body. Additionally, the threads allows for tuning of the height of the support body in relation to the body and other lamp elements. In a preferred embodiment, the threads can be locked via a set screw or other fastener to prevent movement of the support body once assembly has been completed. Alternatively, the support body can be attached to the body via an adhesive process (e.g., glue), welding, or other technique. Of course, there can be other variations, modifications, and alternatives.

In a specific embodiment, the lamp has a gas-filled vessel coupled to the support first end of the support body. In a preferred embodiment, the gas filled vessel has a transparent or translucent body, an inner surface and an outer surface, a cavity formed within the inner surface. In a specific embodiment, the gas filled vessel is a bulb, which holds an inert gas such as Argon and a light emitter or fluorophor such as Mercury, Sodium, Dysprosium, Sulfur or a metal halide salt such as Indium Bromide, Scandium Bromide, Thallium Iodide, Holmium Bromide, Cesium Iodide or other similar materials (or it can simultaneously contain multiple light emitters or fluorophors). Of course, there can be other variations, modifications, and alternatives.

As also shown, the lamp comprises an air resonator structure 422, which may be substantially free from a dielectric body previously described. In other embodiments, the air resonator structure may be combined with the dielectric body or other body. In a preferred embodiment, the air resonator structure comprises a volume of one or more fluid materials. The one or more fluid materials may be from air, nitrogen, argon or other inert gas, or any combination of these, among others, according to one or more embodiments. The fluid can also be any one or a combination of gas, vapor, liquid, or other non-solid material(s), among other like materials. In a preferred embodiment, the fluid is substantially free from moisture and is dry. The dry fluid is useful to prevent parasitic losses from, for example, microwave absorption or other influences. In other embodiments, the fluid may be slightly humid. In one or more embodiments, the air resonator structure can be configured in a suitable shape and size to provide a selected capacitance for a resonating frequency from a plurality of frequencies. In a specific embodiment, the fluid can be configured to be annular in shape or other shape to fit or fill around the support member, as shown. In a specific embodiment, the fluid region has a selected size and shape to provide the selected capacitance for the resonating frequency. Of course, there can be other variations, modifications, and alternatives.

As noted, the lamp also has other elements. In a specific embodiment, the lamp also has an rf source operably coupled to at least the first end of the gas-filled vessel. In a specific embodiment, the rf source is configured with the fluid region to output the resonating frequency for a discharge of one or more gases in the gas filled vessel. The rf source includes an amplifier or other suitable device. Of course, there can be other variations, modifications, and alternatives.

Figure 4C:
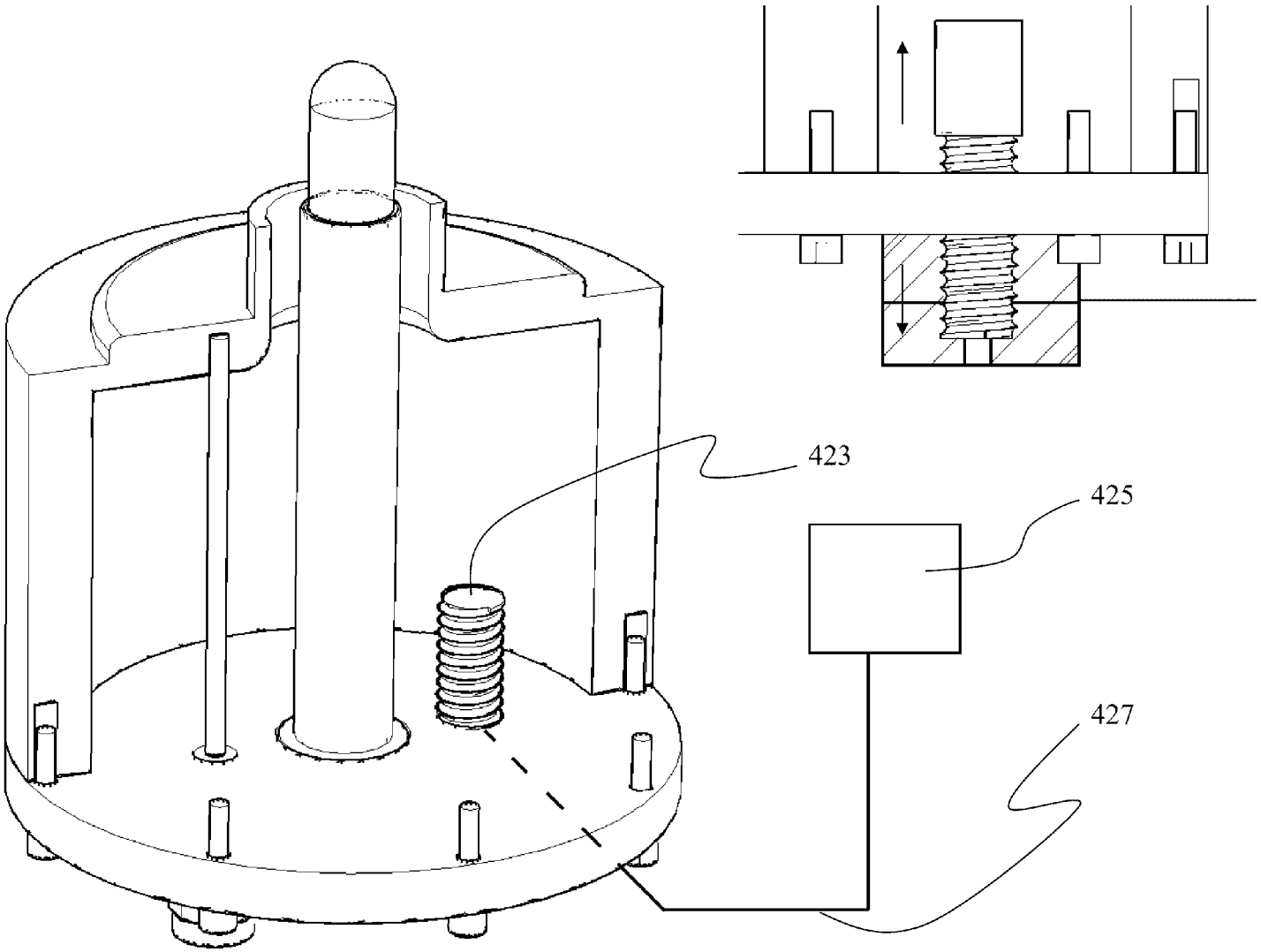
FIG. 4C is a perspective view of a lamp device illustrating a tuning stub/drive and bulb assembly according to an embodiment of the present invention.
Figure 4D:
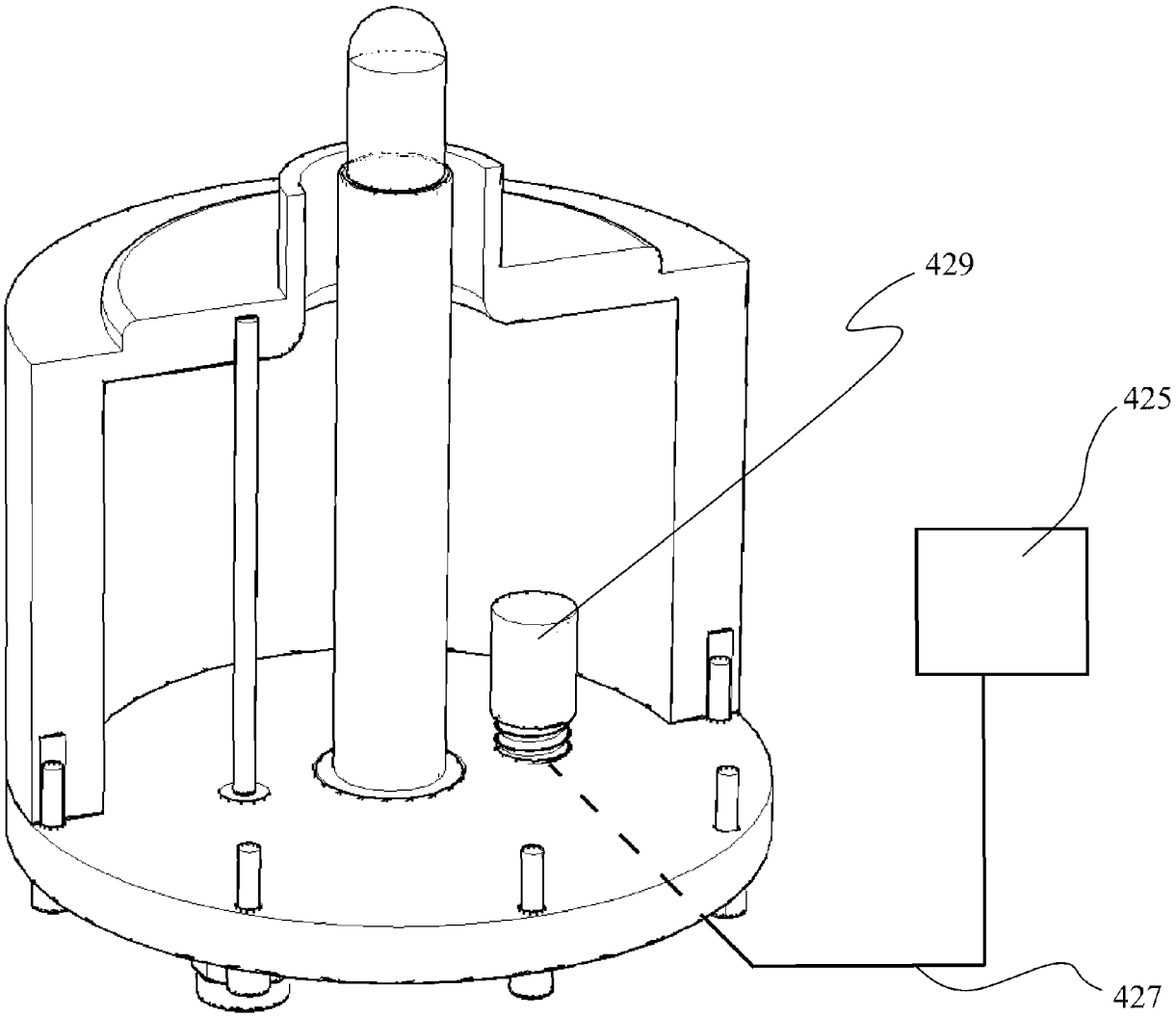
FIG. 4D is a perspective view of a lamp device illustrating a tuning stub/drive device and bulb assembly according to an alternative embodiment of the present invention.

FIGS. 4C and 4D are perspective views of a lamp device illustrating a tuning stub/drive device and bulb assembly according to an embodiment of the present invention. As shown, FIG. 4D also shows a dielectric material coupled to the tuning stub. This diagram is merely an illustration, which should not limit the scope of the claims herein. One of ordinary skill in the art would recognize other variations, modifications, and alternatives. Like reference numerals are used in the present embodiment for illustrative purposes only without limiting the scope of the claims herein. As shown, the present invention provides a plasma lamp apparatus. The lamp has a housing (e.g., metal) having a spatial volume defined within the housing. The spatial volume has an inner region and an outer region. In a specific embodiment, the housing is made of a conductive or metal material, but can be others. Of course, there can be other variations, modifications, and alternatives.

In a specific embodiment, the lamp also has a support region coupled to the inner region of the spatial volume. In a specific embodiment, the support region can be made from a portion of the housing or other separate member. Of course, there can be other variations, modifications, and alternatives. In a specific embodiment, the support region can be annular, polygon shaped, or other shape to be configured to a support body, which will be described further below.

As shown, the lamp further has a support body (output coupling element) having an outer surface region disposed within or partially disposed within the support region. In a specific embodiment, the support body has a support length, a support first end, and a support second end. In a specific embodiment, the support body is made of a conductive metal material, or a dielectric material coated with a highly electrically conductive metallic layer, or other suitable materials. As also shown, one end of the support body can be configured with mechanical threads or other attachment means to mechanically couple to one or more portions of the housing. In a preferred embodiment, the mechanical threads can allow for ease in manufacturing and/or replacement of the support body. Additionally, the threads allows for tuning of the height of the support body in relation to the body and other lamp elements. In a preferred embodiment, the threads can be locked via a set screw or other fastener to prevent movement of the support body once assembly has been completed. Alternatively, the support body can be attached to the body via an adhesive process (e.g., glue), welding, or other technique. Of course, there can be other variations, modifications, and alternatives.

In a specific embodiment, the lamp has a gas-filled vessel coupled to the support first end of the support body. In a preferred embodiment, the gas filled vessel has a transparent or translucent body, an inner surface and an outer surface, a cavity formed within the inner surface. In a specific embodiment, the gas filled vessel is a bulb, which holds an inert gas such as Argon and a light emitter or fluorophor such as Mercury, Sodium, Dysprosium, Sulfur or a metal halide salt such as Indium Bromide, Scandium Bromide, Thallium Iodide, Holmium Bromide, Cesium Iodide or other similar materials (or it can simultaneously contain multiple light emitters or fluorophors). Of course, there can be other variations, modifications, and alternatives.

As also shown, the lamp comprises an air resonator structure, which may be substantially free from a dielectric body previously described. In other embodiments, the air resonator structure may be combined with the dielectric body or other body. In a preferred embodiment, the air resonator structure comprises a volume of one or more fluid materials. The one or more fluid materials may be from air, nitrogen, argon or other inert gas, or any combination of these, among others, according to one or more embodiments. The fluid can also be any one or a combination of gas, vapor, liquid, or other non-solid material(s), among other like materials. In a preferred embodiment, the fluid is substantially free from moisture and is dry. The dry fluid is useful to prevent parasitic losses from, for example, microwave absorption or other influences. In other embodiments, the fluid may be slightly humid. In one or more embodiments, the air resonator structure can be configured in a suitable shape and size to provide a selected capacitance for a resonating frequency from a plurality of frequencies. In a specific embodiment, the fluid can be configured to be annular in shape or other shape to fit or fill around the support member, as shown. In a specific embodiment, the fluid region has a selected size and shape to provide the selected capacitance for the resonating frequency. Of course, there can be other variations, modifications, and alternatives.

As noted, the lamp also has other elements. In a specific embodiment, the lamp also has an rf source operably coupled to at least the first end of the gas-filled vessel. In a specific embodiment, the rf source is configured with the fluid region to output the resonating frequency for a discharge of one or more gases in the gas filled vessel. The rf source includes an amplifier or other suitable device. Of course, there can be other variations, modifications, and alternatives.

In one or more embodiments, the present apparatus also has a tuning device 423 operably coupled to one or more portions of the one or more fluid materials. In a specific embodiment, the tuning device is configured to change a resonating frequency from at least a first value to a second value. Each of the values can be a single or range of values according to one or more embodiments. As shown, the tuning device is configured and coupled to one or more portions of the housing, but configured in other places.

Depending upon the embodiment, the tuning device is made of a suitable material and configured with a size and shape. In one or more embodiments, the tuning device comprises a tuning stub insertable into the outer region of the housing to change a volume of the one or more fluid materials from a first volume to a second volume. That is, the volume is typically reduced when the tuning stub is inserted into the volume region. In a specific embodiment, the tuning device comprises quartz body 429 configured around one or more portions of the support body. Preferably, the quartz body is configured in the spatial size to provide the resonating frequency from a plurality of frequencies according to a specific embodiment. Alternatively, the tuning device comprises at least a dielectric material, a metal material, or a semiconductor material. The device, which includes the stub, can be made substantially of a metal, a dielectric, or a semiconductor material, which is homogeneous, or a composite. In other embodiments, the device can layered or have other spatial configurations.

In a preferred embodiment, the tuning device comprises a tuning stub insertable into the outer region to change a volume of the one or more fluid materials from a first volume to a second volume and a drive device coupled to the tuning stub. In one more embodiments, the drive device comprising at least a motor, a piezoelectric material, or MEMS, or other apparatus/device capable of causing the stub to move spatially into the outer region, or alternatively or in combination, capable of causing the stub to move spatially into and out of the spatial region.

In one or more embodiments, the apparatus also includes a feedback process 425 coupled to the drive device 427. The feedback process is configured to receive feedback of one or more parameters from an output of the lamp device. Such output can be voltage, current, impedance, reflected rf, electromagnetic radiation, temperature, frequency or frequencies, or others, or combinations. In a preferred embodiment, one or more parameters can include reflected rf power from an input coupling element and/or electromagnetic radiation (e.g., visible) output from the bulb. The feedback process can include one or more photovoltaic sensors configured to capture the electromagnetic output. The feedback process automatically or semi-automatically causes the drive device to maintain or cause movement of the stub to increase and/or reduce the spatial volume within the housing. As an example, the feedback process uses an rf coupler configured to a sensor (e.g., diode), which are overseen by a micro-processor/controller unit. The processer/controller unit receives information derived from feedback from the bulb and outputs control signals to the drive device. Depending upon the feedback, the drive device is configured to move the stub in and out of the air resonator region to change its volume. The change in volume effectively leads to a change in the size of the air resonator structure according to a specific embodiment. The feedback process leads to an efficient control of output (e.g., maximum, dimming, minimum) of light from the bulb. Further details of the tuning device can be found throughout the present specification and more particularly below.

Still further, the present lamp includes a tuning device configured for temperature compensation. In a specific embodiment, the tuning device comprises one or more materials such as a dielectric. Such materials can be titanium based materials, tantalum based materials, aluminum based materials, zinc based materials (e.g., BaZnCoNb), barium based materials (e.g., BaZnTa Oxide, BaZnCoNb), combinations, and others. In a specific embodiment, the one or more materials are configured to have an effective dielectric constant to provide a range of resonating frequencies within a range of operating temperatures. Of course, there can be other variations, alternatives, and modifications. That is, any one or more of the features and/or elements of FIGS. 4A, B, C, and D may be combined, further separated, or modified depending upon one or more embodiments.

Figure 5:
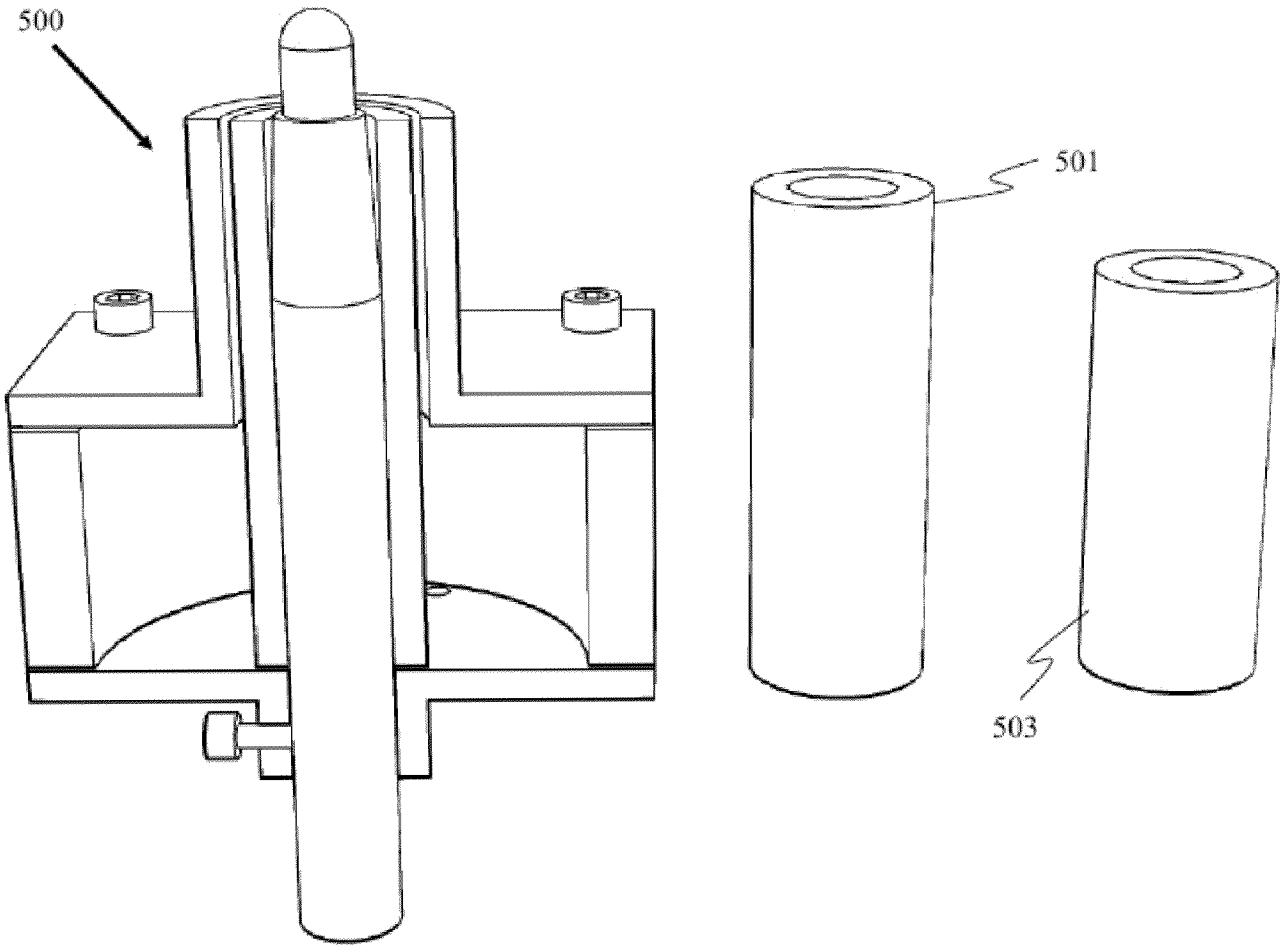
FIG. 5 illustrates simplified lamp devices having sized quartz bodies to effect resonating frequencies according to embodiments of the present invention.
Figure 6:
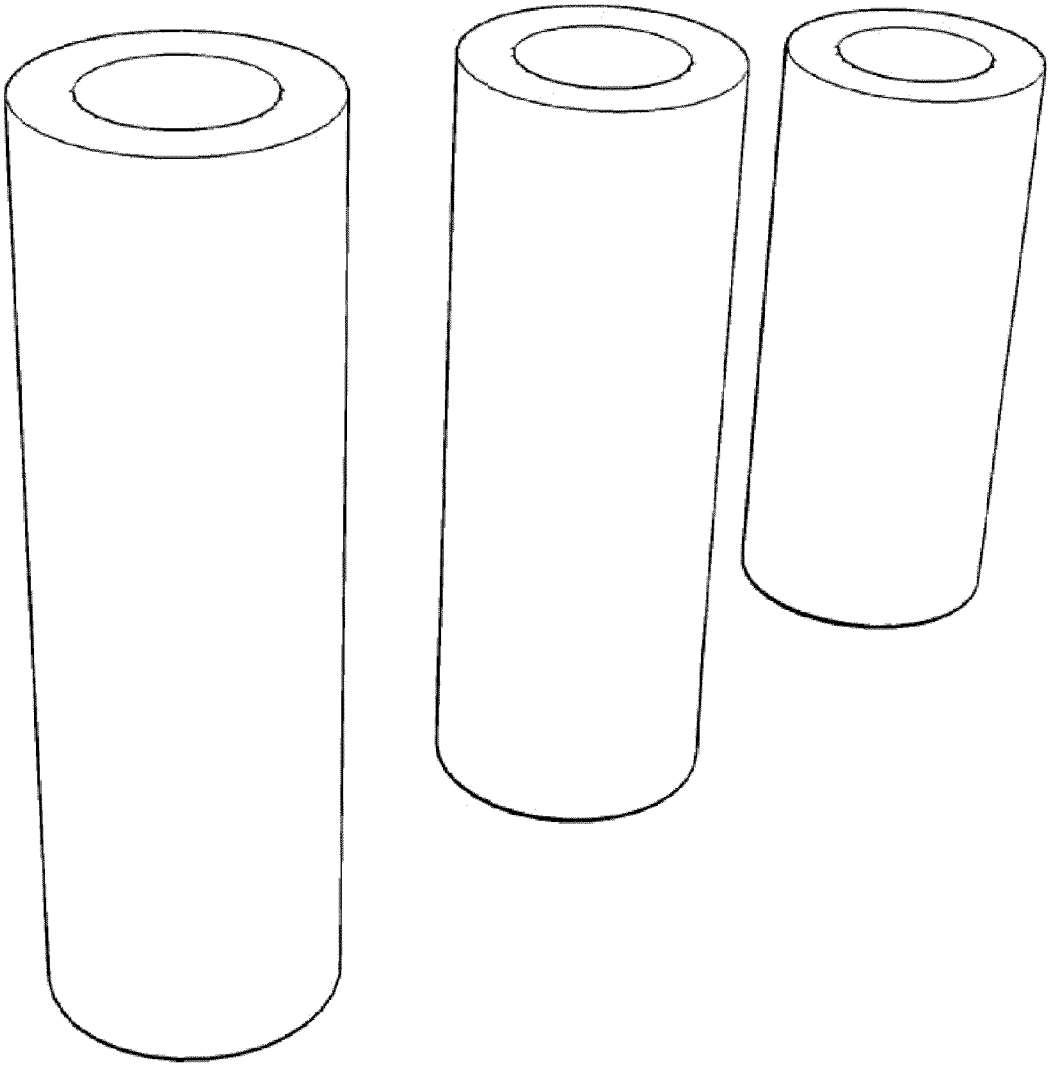
FIG. 6 is a simplified diagram of a quartz body according to an embodiment of the present invention.

FIG. 5 illustrates simplified lamp devices 500 having sized quartz bodies to effect resonating frequencies according to embodiments of the present invention. This diagram is merely an illustration, which should not limit the scope of the claims herein. One of ordinary skill in the art would recognize other variations, modifications, and alternatives. In a specific embodiment, each of the quartz bodies can be configured with a different size 501, 503, but can be others. In a specific embodiment, the different size can be predominately a different height although there can be diameter and other configurations. Of course, there can be other variations, modifications, and alternatives. Other configurations of quartz bodies are provided in FIG. 6, which is a simplified diagram of a quartz body according to an embodiment of the present invention. This diagram is merely an illustration, which should not limit the scope of the claims herein. One of ordinary skill in the art would recognize other variations, modifications, and alternatives.

Figure 7:
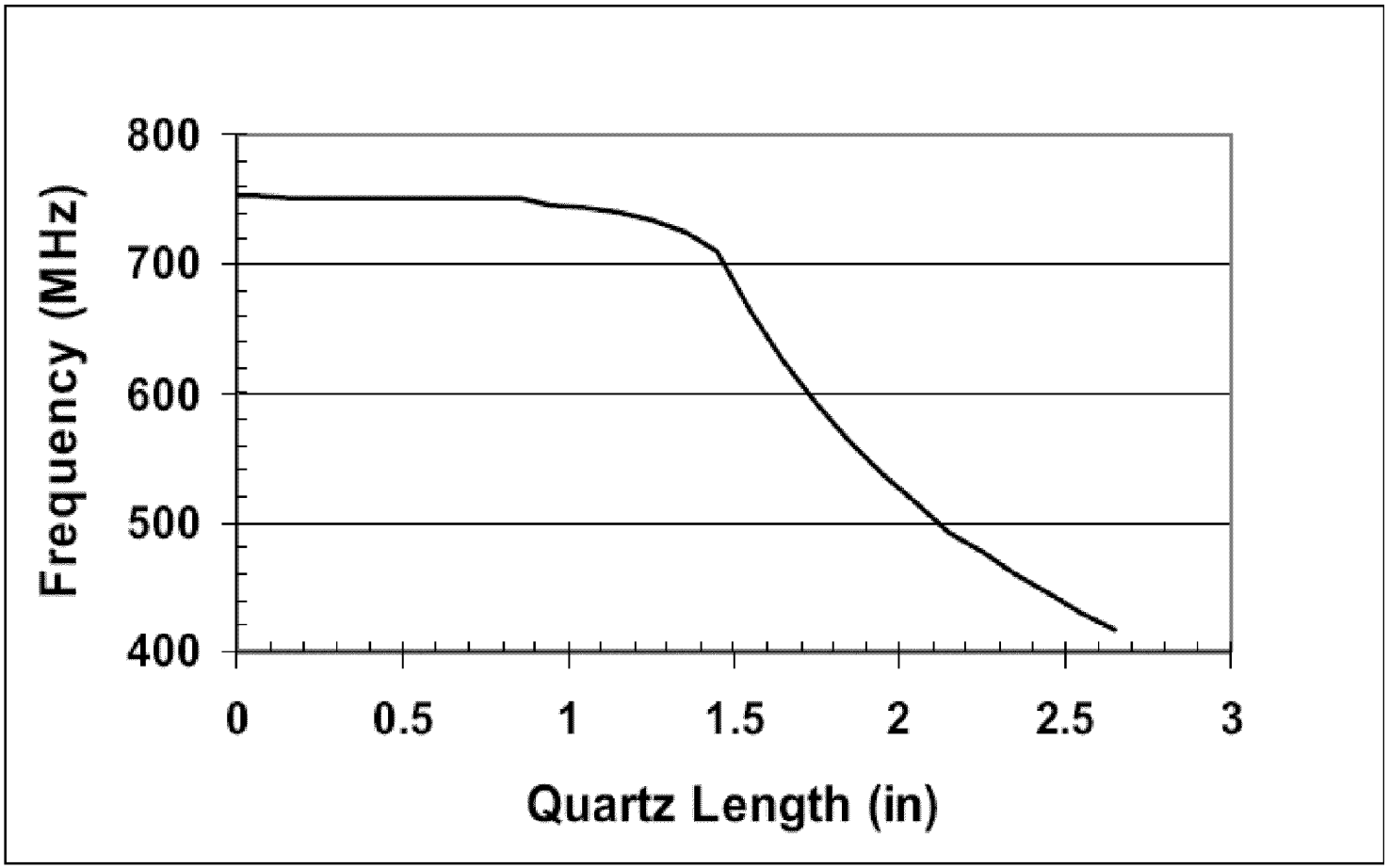
FIG. 7 is a simplified diagram illustrating the relationship between quartz body length and resonating frequency according to an embodiment of the present invention.

FIG. 7 is a simplified diagram 700 illustrating the relationship between quartz body size and resonating frequency according to an embodiment of the present invention. This diagram is merely an illustration, which should not limit the scope of the claims herein. One of ordinary skill in the art would recognize other variations, modifications, and alternatives. As shown in the Figure the horizontal axis is length of the quartz and the vertical axis is frequency, although there may be other relationships. In a specific embodiment, as the height of the quartz increases (increasing length), resonating frequency decreases. Of course, there can be other variations, modifications, and alternatives.

While the above is a full description of the specific embodiments, various modifications, alternative constructions and equivalents may be used. As an example, the tuning device can be a dielectric sleeve with one or more spatial configurations, which may be moved relative to the support member. Alternatively, the tuning device can also be inserted within the air resonator structure, which causes it to change in volume and lead to changes in resonating frequencies. In other embodiments, the tuning device can be a combination of these, among other elements. Therefore, the above description and illustrations should not be taken as limiting the scope of the present invention which is defined by the appended claims.

What is claimed is:

1. A method of manufacturing plasma lamps, the method comprising:

providing a plasma lamp apparatus comprising a housing having a spatial volume defined within the housing, the spatial volume having an inner region and an outer region, the plasma lamp assembly also having a support region coupled to the inner region of the spatial volume;

inserting a lamp device comprising a gas filled vessel coupled to a support body to a region within or partially within the support region of the inner region of the spatial volume of the housing;

selecting a spatial size of a quartz body to provide a resonating frequency from a plurality of resonating frequencies; and disposing the quartz body around the support body, the quartz body being configured in the spatial size to provide the resonating frequency from a plurality of frequencies.

2. An electrode-less plasma lamp comprising:

a plasma lamp apparatus comprising a housing having a spatial volume defined within the housing, the spatial volume having an inner region and an outer region, the plasma lamp assembly having a support region coupled to the inner region of the spatial volume;

one or more fluid materials within the outer region of the housing;

a support body provided within or partially within the support region of the housing;

a lamp device comprising a gas filled vessel coupled to at least one end of the support body;

a radio frequency (RF) coupling element provided within one or more portions of the outer region, the RF coupling element being configured to supply energy to the plasma lamp device; and a tuning device operably coupled to one or more portions of the one or more fluid materials and configured to change a resonating frequency from at least a first value to a second value.

3. The plasma lamp of claim 2 wherein the one or more fluid materials forms an air resonator region.

4. The plasma lamp of claim 2 wherein the tuning device comprises a tuning stub insertable into the outer region to change a volume of the one or more fluid materials from a first volume to a second volume.

5. The plasma lamp of claim 2 wherein the tuning device comprises quartz body configured around one or more portions of the support body, the quartz body being configured in the spatial size to provide the resonating frequency from a plurality of frequencies.

6. The plasma lamp of claim 2 wherein the tuning device comprises at least a dielectric material, a metal material, or a semiconductor material.

7. The plasma lamp of claim 2 wherein the tuning device comprises a tuning stub insertable into the outer region to change a volume of the one or more fluid materials from a first volume to a second volume and a drive device coupled to the tuning stub.

8. The plasma lamp of claim 2 wherein the tuning device comprises a tuning stub movable into one or more portions of the one or more fluid materials and a drive device coupled to the tuning stub, the drive device comprising at least a motor, a piezoelectric material, or MEMS, the drive device being coupled to a feedback process.

9. The plasma lamp of claim 2 wherein the one or more fluid materials is substantially dry air or nitrogen maintain the outer region substantially free from at least arcing.

10. The plasma lamp of claim 2 wherein the housing comprises an electrically conductive material.

11. The plasma lamp of claim 2 wherein the tuning device comprises one or more materials, the one or more materials having an effective dielectric constant configured to provide a range of resonating frequencies within a range of operating temperatures.

12. A method of configuring a plasma lamp device, the method comprising:

providing a plasma lamp apparatus comprising a housing having a spatial volume defined within the housing, the spatial volume having an inner region and an outer region, the plasma lamp assembly having a support region coupled to the inner region of the spatial volume, the outer region comprising one or more fluid materials to form a cavity region;

coupling a support body provided within or partially within the support region of the housing;

coupling a lamp device comprising a gas filled vessel coupled to at least one end of the support body;

coupling a radio frequency (RF) coupling element provided within one or more portions of the outer region, the RF coupling element being configured to supply energy to the plasma lamp device; and providing a tuning device operably coupled to one or more portions of the one or more fluid materials and configured to change a resonating frequency from at least a first value to a second value.

* * * * *